US008878417B2

(12) United States Patent
Luo et al.

(10) Patent No.: US 8,878,417 B2
(45) Date of Patent: Nov. 4, 2014

(54) COMMUTATOR

(75) Inventors: Guo Hua Luo, Shenzhen (CN); Jing Chao Zheng, Shenzhen (CN); Yiu Chung Wu, Hong Kong (CN); Chi Hang To, Hong Kong (CN)

(73) Assignee: Johnson Electric S.A., Murten (CH)

( * ) Notice: Subject to any disclaimer, the term of this patent is extended or adjusted under 35 U.S.C. 154(b) by 562 days.

(21) Appl. No.: 13/073,413

(22) Filed: Mar. 28, 2011

(65) Prior Publication Data

US 2011/0234040 A1 Sep. 29, 2011

(30) Foreign Application Priority Data

Mar. 26, 2010 (CN) ..... 2010 1 0137156

(51) Int. Cl.
*H01R 39/04* (2006.01)
*H01R 43/06* (2006.01)

(52) U.S. Cl.
CPC ..... *H01R 39/045* (2013.01); *H01R 43/06* (2013.01)
USPC ..... 310/233; 310/234; 310/235; 310/236; 310/237

(58) Field of Classification Search
CPC ..... H01R 39/04; H01R 39/045; H01R 43/06
USPC ..... 310/233, 234, 235, 236, 237
See application file for complete search history.

(56) References Cited

U.S. PATENT DOCUMENTS

| | | | | |
|---|---|---|---|---|
| 3,996,660 | A * | 12/1976 | Hancock | 29/597 |
| 5,793,140 | A * | 8/1998 | Tuckey | 310/237 |
| 6,222,298 | B1 * | 4/2001 | Saito et al. | 310/233 |
| 6,710,500 | B1 * | 3/2004 | Wagner et al. | 310/233 |
| 6,833,650 | B2 | 12/2004 | Hara et al. | |
| 7,084,547 | B2 * | 8/2006 | Moroto et al. | 310/233 |
| 2002/0180304 | A1 * | 12/2002 | Knauff | 310/261 |
| 2003/0094877 | A1 * | 5/2003 | Hara et al. | 310/233 |
| 2004/0181931 | A1 * | 9/2004 | Sugiyama | 29/597 |

FOREIGN PATENT DOCUMENTS

| | | |
|---|---|---|
| JP | 6236829 A | 8/1994 |
| JP | 6315249 A | 11/1994 |

* cited by examiner

*Primary Examiner* — Terrance Kenerly
(74) *Attorney, Agent, or Firm* — Muncy, Geissler, Olds & Lowe, P.C.

(57) ABSTRACT

A carbon commutator, for an electric motor, has a plurality of segments forming a brush contact surface and a hub supporting the segments. Each segment has a connector having a terminal for connection of a lead wire, a carbon layer forming the brush contact surface, and a connecting layer fixed to the carbon layer and electrically connecting the carbon layer to the connector. A plurality of micro structures is formed at the interface between the connecting layer and the carbon layer.

18 Claims, 5 Drawing Sheets

COMMUTATOR

CROSS REFERENCE TO RELATED APPLICATIONS

This non-provisional patent application claims priority under 35 U.S.C. §119(a) from Patent Application No. 201010137156.6 filed in The People's Republic of China on Mar. 26, 2010.

FIELD OF THE INVENTION

This invention relates to a commutator and in particular, to a commutator for a miniature electric motor having a plurality of carbon segments forming a brush contact surface, and to a method of making such a commutator.

BACKGROUND OF THE INVENTION

FIG. 9 is an exploded view of a partially constructed prior art planar carbon segment commutator. The commutator has a copper connector 10' which is in the form of a disc with radially extending arms. A non-conductive hub 30', typically of phenolic, is over molded to the copper connector. A carbon disc 20' is soldered to the copper connector 10' and then the radial arms are bent into U-shape terminals or tangs for connection of armature lead wires. Then the copper/carbon disc assembly is cut into a plurality of individual commutator segments, held together by the hub. As it is very difficult to solder directly to the carbon disc, the surface of the carbon disc to be soldered to the connector is first electroplated with a layer of nickel 40' and then a layer of copper 45' is electroplated to the nickel layer. Usually a layer of solder 50' is applied to the layer of copper to ensure good adhesion and reliability of the solder connection to the copper connector. Small fingers or anchors are integrally formed on the copper connector to strengthen the fixation of the connector 10' to the hub 30'.

However, even with the nickel plating 40' and copper plating 45', the solder connection between the carbon disc 20' and the copper connector 10' is problematic. The bonding force between the carbon disc and the nickel layer is weak and the plating processes are time consuming and expensive. Furthermore, during electroplating, the electroplating solution may penetrate the carbon layer and is difficult to remove. If the electroplating solution is not removed it will erode the coatings thereby reducing electrical conductivity between the carbon disc and the copper connector and reducing the working life of the commutator.

Carbon commutators in which the carbon layer is directly molded to the copper connector are known but in practice the electrical connection between the carbon and the copper has a higher contact resistance than the soldered commutators and requires a thicker layer of carbon to ensure good physical strength. This also added resistance to the current path through the commutator from brush contact surface to tang. For extra low voltage applications and for high current applications this additional resistance is a issue. For high current applications the added resistance results in excessive heating of the commutator.

Hence there is a desire for an improved carbon commutator which can solve the above-mentioned problems.

SUMMARY OF THE INVENTION

Accordingly, in one aspect thereof, the present invention provides a commutator for an electric motor, comprising: a plurality of segments forming a brush contact surface; and a hub supporting the segments in spaced relationship, wherein each segment comprises a connector having a terminal for connection of a lead wire, a carbon layer forming the brush contact surface, and a connecting layer, electrically and mechanically fixed to the carbon layer and electrically connecting the carbon layer to the connector, and wherein a plurality of micro structures is formed at the interface between the connecting layer and the carbon layer.

Preferably, the micro structures form a plurality of micro holes in a surface of the connecting layer and the carbon layer penetrates into the micro holes.

Preferably, the micro holes have a diameter of less than 0.5 mm.

Preferably, the connecting layer is formed from material selected from the group: metal foam and metal fiber felt.

Preferably, the material of the connecting layer is copper, nickel or alloys thereof.

Preferably, the connecting layer is soldered to the connector.

Alternatively, the micro structures form a plurality of bur like projections extending from a surface of the connecting layer and the bur like projections penetrate into the carbon layer.

Preferably, the bur like projections have a diameter of less than 0.5 mm.

Preferably, the carbon layer is sintered after the connecting layer has been attached.

Preferably, the connecting layer has a solder layer applied to the surface remote from the carbon layer.

Alternatively, the connecting layer and the connector are formed as a monolithic structure.

Preferably, the commutator is a planar type commutator or a cylindrical type commutator.

Preferably, the hub is molded to the segments and the connector has at least one anchor which extends into the hub to aid attachment.

According to a second aspect, the present invention provides a method of forming a commutator for an electric motor, the method comprising the steps of: providing a carbon layer blank in the form of an annular ring of carbon powder; providing a connecting layer blank in the form of a annular ring of conductive material having a plurality of micro structures; forming a carbon portion blank by pressing the annular rings together to cause the carbon powder to engage with the micro structures of the conductive material; heating the carbon portion blank to combine the carbon material into a stable mass, providing a connector blank in the form of an annular disc of conductive material; molding a hub to the connector blank; soldering the carbon portion blank to the connector blank to form a segment blank; and dividing the segment blank into a plurality of individual segments supported by the hub.

Preferably, the method includes the step of applying a layer of solder to an exposed surface of the connecting layer blank in the carbon portion blank before soldering the carbon portion blank to the connector blank.

Preferably, the method includes the step of forming the connecting layer blank from a copper metal foam or a metal fiber felt and forming the micro structures as micro holes.

Preferably, the method includes the steps of providing the connector blank with a plurality of integral radially extending arms and deforming the arms to form terminals for the attachment of lead wires after molding the hub to the connector blank.

Alternatively, the method includes the step of forming a plurality of bur like projections on the conductive layer to form the micro structures.

Alternatively, the method includes the step of forming the micro structures at a surface of the connector blank and using the connector blank as the connecting layer blank and eliminating the step of soldering the carbon portion blank to the connector blank.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
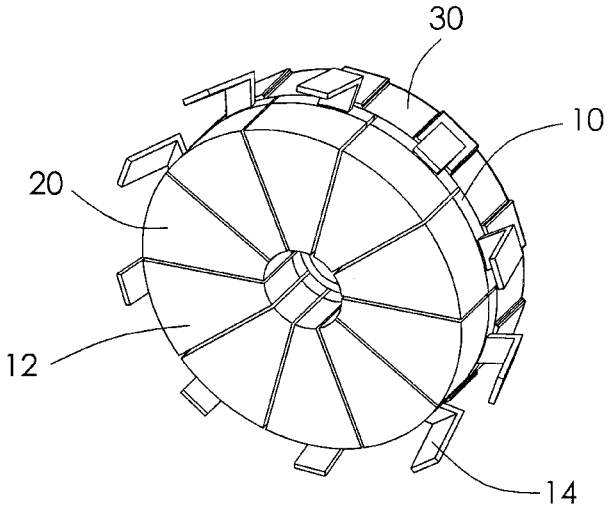
FIG. 1 illustrates a planar carbon segment commutator, according to the preferred embodiment of the present invention.

The commutator of FIG. 1 is a planar type carbon segment commutator for use in small electric motors such as miniature PMDC motors. This type of commutator is commonly known as a planar carbon commutator.

Figure 4:
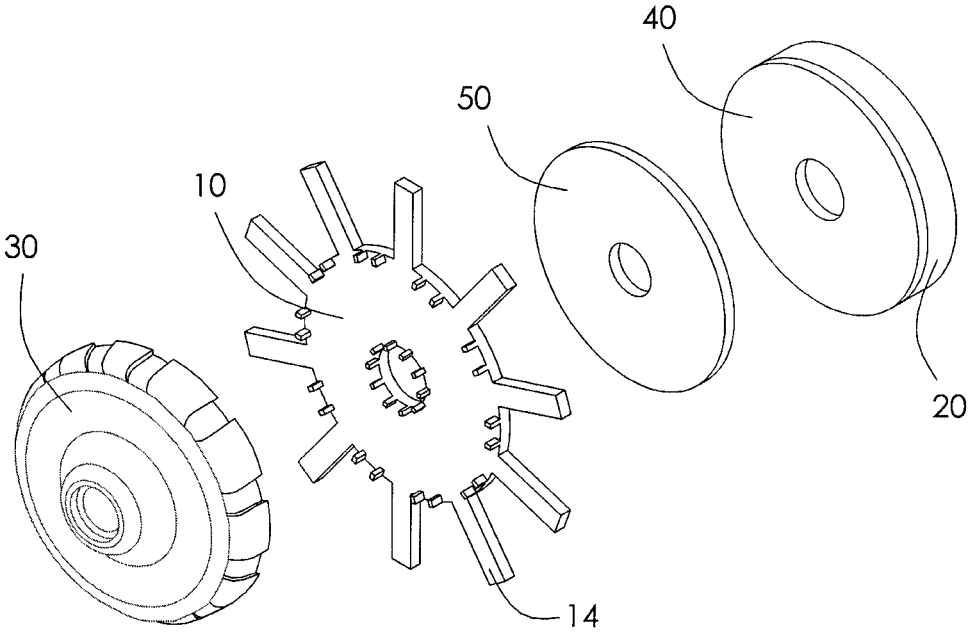

The commutator is shown in exploded form in FIG. 4 and has a hub 30 made of a non-conductive material, such as phenolic. The hub supports a plurality of commutator segments 12 arranged to form a planar brush contact surface. Each segment has a connector made of a conductive material, preferably copper, and having a terminal or tang for connecting the segment to a wire of the armature winding. Attached to one side of the connector is a carbon portion. The carbon portion is soldered to a broad surface of the connector 10. The carbon portion has a carbon layer and a connecting layer. The connecting layer is electrically conductive and made from a solderable material, such as copper. The connecting layer has a plurality of micro structures for connecting the connecting layer to the carbon layer. Preferably, the connecting layer is porous, having a plurality of micro holes or pores and the carbon layer penetrates into the micro holes to physically and electrically connect the carbon layer to the connecting layer. Micro holes mean holes with very small diameter which is usually less than 1 mm. Preferably, the diameter of the micro holes is less than 0.5 mm.

Preferably, the material of the connecting layer is a copper foam, although other metal foam materials or metal fiber felts, or other conductive materials having a porous structure may be suitable. The material of the connecting layer may be metal, alloy, or a composition deposition structure made of metal particles and non-metal particles and/or carbon fiber material.

Preferably, the connecting layer 40 is a metal foam made by electroplating or power metallurgy or any other process. Alternatively, the connecting layer 40 is a metal fiber felt which may be made by electroplating or power metallurgy or any other process. The metal may be Ni, Fe, Cu, Sn, Zn, Al, Ti, Mo, W, Ni—W alloy, Cu—Zn alloy, Cu—Sn alloy and other metal/alloy or compound made of metal/alloy and ceramic or other non-metal. Cu, Ni, Cu alloys and Ni alloys are preferred.

The material of the carbon layer may be carbon material or carbon material with metal coating or carbon material with sintered metal. In the powder form the carbon material may include a binder to hold the powder particles together.

Optionally, the outer surface of the connecting layer is coated with a layer of solder or tin to increase the solderability of the carbon portion to the connector on the assembly line.

Figure 2:
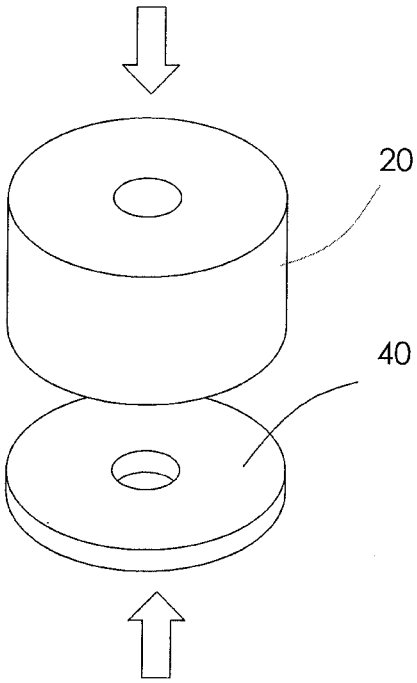
FIG. 2 to FIG. 5 illustrate different stages in the construction of the commutator of FIG. 1.
Figure 3:
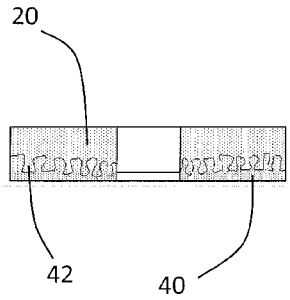

Steps in the construction of the commutator will now be described with reference to FIGS. 2 to 5 to further explain the structure of the commutator. As shown in FIG. 2, the carbon portion is formed by firstly forming a carbon layer blank 20 and a connecting layer blank 40. The carbon layer blank 20 is cylindrical body formed from compacted carbon material powder. The connecting layer blank 40 is an annular disc of the porous material. The carbon layer blank and the connecting layer blank are pressed together so that the carbon material penetrates into the connecting layer blank. It is not necessary for the carbon material to fill all the space inside the connecting layer blank but it is desired that the carbon material penetrates sufficiently to make a good electrical and mechanical connection. FIG. 3 is a cross sectional view of the formed carbon portion blank, showing schematically (and on an exaggerated scale) that the micro holes 42 in the connecting layer 40 have been filled by the material of the carbon layer blank 20 after the two parts have been pressed together. The carbon portion blank is now heated to 'set' the carbon layer. This heating may be a curing process wherein the binder in the carbon material is effectively melted and solidified to strongly bind the powder particles together. This is a cost effective process but the binder affects the conductivity of the carbon layer. Alternatively, the heating may be a sintering process in which the carbon portion blank is heated to a higher temperature to sinter the carbon material and to vaporize or carbonize the binder and other impurities in the carbon material powder. This produces a stronger, harder wearing material having a lower resistivity and more securely connects the connecting layer to the carbon layer with a lower connection resistance.

Figure 5:
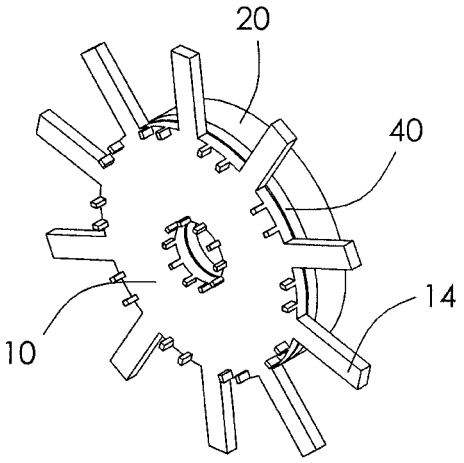

FIG. 5 illustrates the segment blank formed by soldering the carbon portion blank 20,40 to the connector blank 10, with or without the optional solder layer added to the carbon portion blank. Visible in FIG. 5 are the anchors on the opposite side of the connector blank which are to be embedded in the hub when the hub is molded to the segment blank. The hub is molded to the connector blank before the carbon portion blank is soldered to the connector blank. The radial arms of the connector blank are deformed to form the terminals after the hub is molded to the connector blank and preferably before the carbon portion blank is attached. After the terminals have been formed and the carbon blank has been attached to the connector blank to form the segment blank, the segment blank is divided into the individual segments which are held in place by the hub 30, to produce the completed commutator of FIG. 1.

Figure 6A:
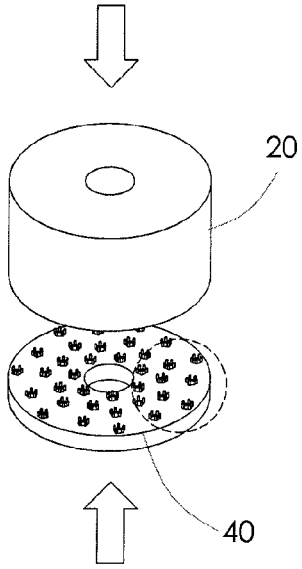
FIGS. 6A to 6C illustrate an alternative electrically conductive brush contact part and connecting layer.
Figure 6B:
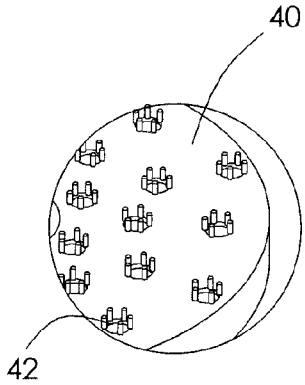
Figure 6C:
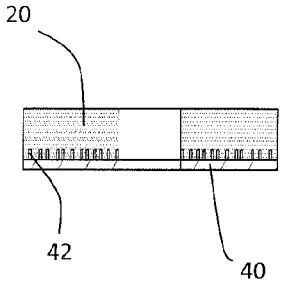

FIGS. 6A to 6C show construction of an alternative carbon portion blank according to a second embodiment. FIG. 6A shows the carbon layer blank 20 and the connecting layer blank 40 about to be pressed together to form the carbon portion blank. FIG. 6B shows a portion of the connecting layer blank 40 of FIG. 6A on an enlarged scale to show details of the micro structures 42. FIG. 6C is a schematic cross section of the completed carbon portion blank. The surface of the connecting layer blank 40 which contacts with the carbon layer 20 has a plurality of micro structures in the form of bur like projections. These projections may be formed by electroplating, chemical plating, physical vapor deposition (PVD), chemical vapor deposition (CVD), etching, sintering powder metals or any other known process. After the carbon layer blank 20 and the connecting layer blank 40 are pressed together, the burs 42 of the connecting layer 40 are firmly fixed inside the carbon layer blank 20 thereby securely connecting the connecting layer 40 and the brush contact part 20 together, mechanically and electrically.

Figure 7A:
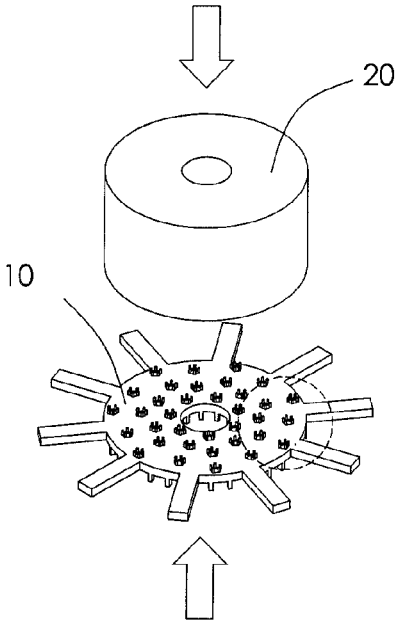
FIGS. 7A to 7C illustrate another alternative electrically conductive brush contact part and connecting layer.
Figure 7B:
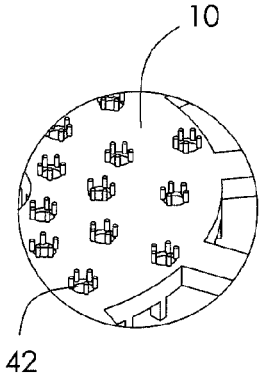
Figure 7C:
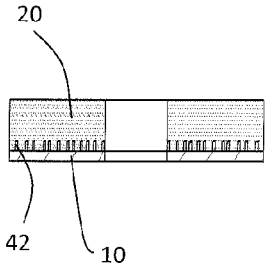

Alternatively, the connecting layer 40 may be integrally formed on the surface of the connector 10. For example, as shown in FIGS. 7A to 7C, the micro structures in the form of bur like projections are integrally formed on a surface of the connector blank 10 via electroplating, chemical plating, physical vapor deposition (PVD), chemical vapor deposition (CVD), etching, sintering powder metals or any other known process. Thus, the process of soldering the connecting layer 40 to the conductive base 10 is omitted. In effect, the connecting layer 40 and the connector 10 have been formed as a single monolithic structure. In FIGS. 7A to 7C, FIG. 7A shows the carbon layer blank 20 and the connector blank 10 about to be pressed together to form the carbon portion blank, FIG. 7B shows a portion of the connector blank 10 of FIG. 7A on an enlarged scale to show details of the micro structures 42, and FIG. 7C is a schematic cross section of the completed carbon portion blank.

Figure 8A:
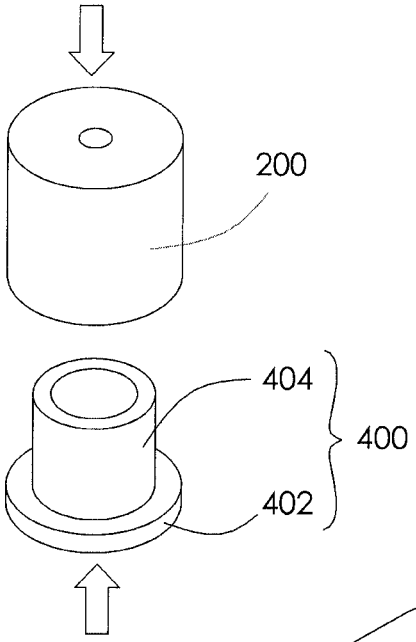
FIGS. 8A to 8C illustrate different stages in the construction of a cylindrical commutator in accordance with a second embodiment of the present invention.
Figure 8B:
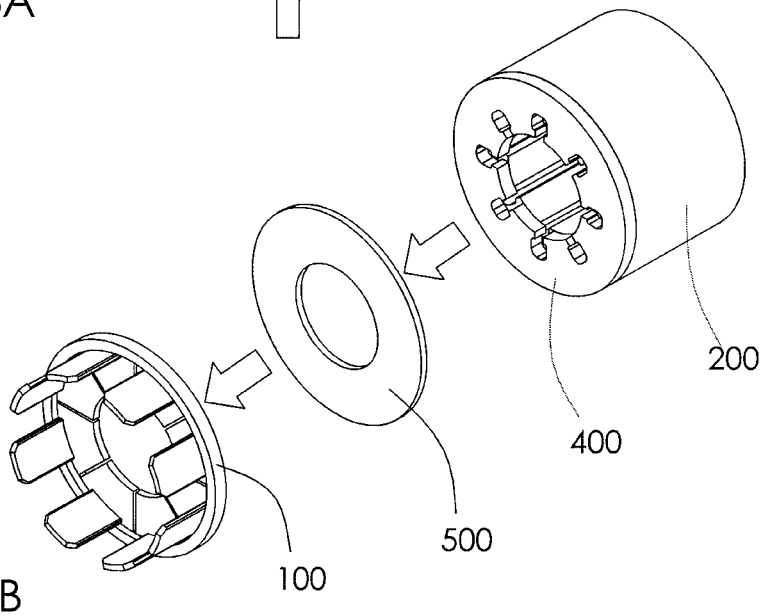
Figure 8C:
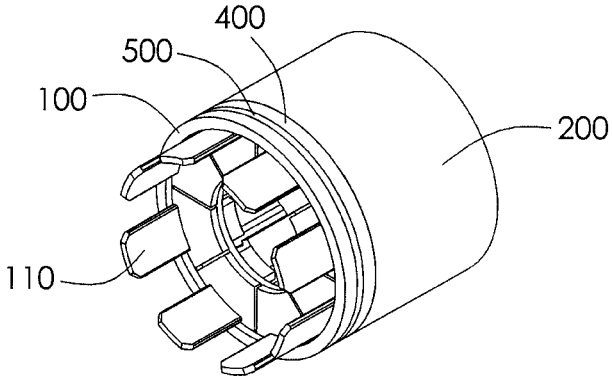
Figure 9:
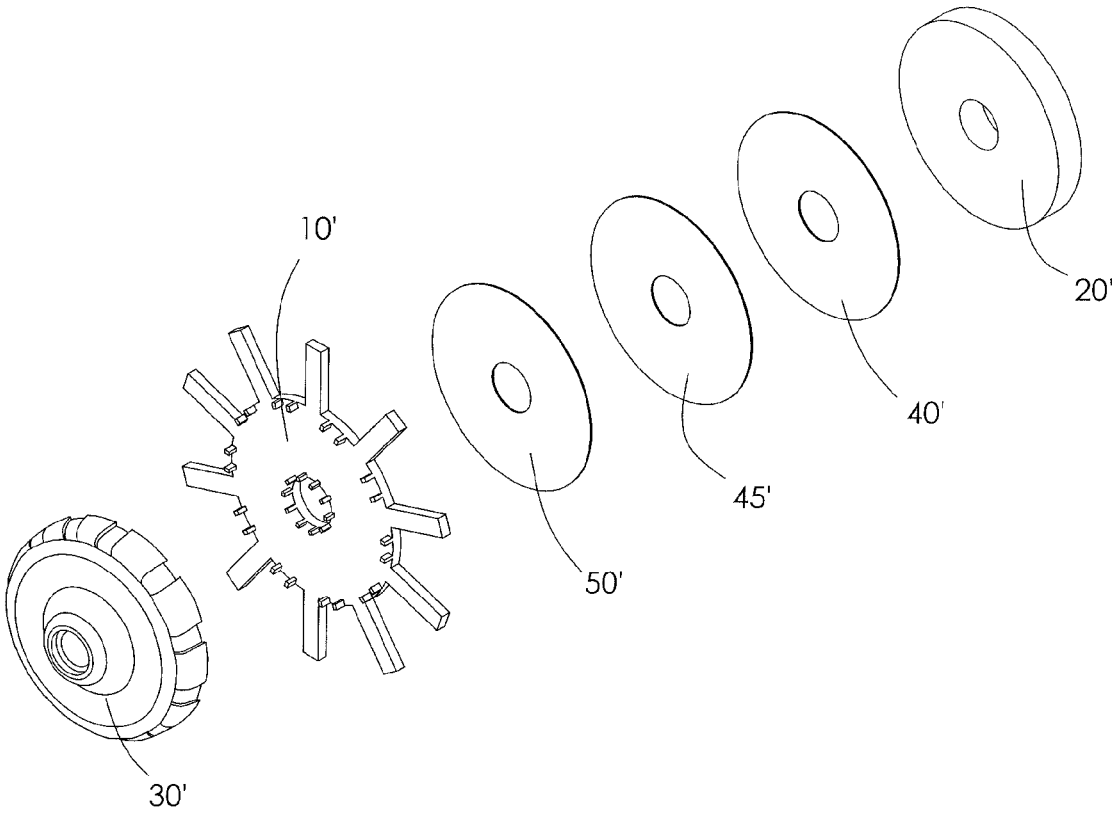
FIG. 9 (Prior Art)
FIG. 9 is an exploded view of a partially constructed prior art carbon segment planar commutator.

FIGS. 8A to 8C show construction of a cylindrical type carbon segment commutator in accordance with another embodiment of the present invention. This type of commutator is commonly called a cylindrical carbon commutator. FIG. 8A shows the formation of the carbon portion blank, FIG. 8B shows an exploded view of the commutator segment blank and FIG. 8C shows the assembled segment blank before adding the hub (not shown) and before being divided into individual segments. The commutator comprises a connector blank 100, a cylindrical carbon layer blank 200 and a connecting layer blank 400 disposed between the base 100 and the brush contact part 200. The connecting layer blank 400 comprises a bottom plate 402 and a cylindrical protrusion 404. The carbon layer blank 200 has a cylindrical circumferential surface forming the brush contact surface and a central receiving space for receiving the protrusion 404 of the connecting layer 400. The surfaces of the connecting layer 400 contacting with the carbon layer 200 have a plurality of micro structures in the form of micro holes and/or burs. After pressing the carbon layer blank 200 and the connecting layer blank 400 together, in the directions of the arrows as shown in FIG. 8A, the connecting layer 400 and the carbon layer 200 become firmly fixed together. The bottom plate 402 of the connecting layer blank 400 which is attached to the bottom surface of the carbon layer blank 200, is electrically and mechanically fixed to the connector blank 100 by soldering, to form the segment blank. Preferably, a solder layer 500 may be applied to the face of the connecting layer blank to improve solderability between the connector blank 100 and the connecting layer blank 400. Preferably, the hub is molded to the connector blank before the carbon portion blank is soldered to the connector blank. Once the segment blank is supported by the hub, the segment blank is divided into individual segments which are supported by the hub. Arms 110 extending from the connector blank form terminals for connecting the segments to wires of the armature.

In the present invention, the interface between the brush contact part 20, 200 and the connecting layer 40, 400 has a plurality of micro holes/burs which greatly improve the electrical connection and mechanical strength between the two parts. The connecting layer 40, 400 replaces the electroplating layer used in traditional commutators, thereby avoiding having the electroplate solution penetrate inside of the brush contact part 20, 200 to reduce the lifespan of the commutator.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

The invention claimed is:

1. A commutator for an electric motor, comprising:

a plurality of segments forming a brush contact surface; and a hub supporting the segments in spaced relationship, wherein each segment comprises a connector having a terminal for connection of a lead wire, a carbon layer forming the brush contact surface, and a connecting layer made from a solderable material, electrically and mechanically fixed to the carbon layer, the carbon layer and the connector being respectively fixed to opposite surfaces of the connecting layer and the connecting layer electrically connecting the carbon layer to the connector, and wherein a plurality of micro structures is formed at the interface between the connecting layer and the carbon layer, the micro structure forming micro holes or projections having a diameter of less than 0.5 mm.

2. The commutator of claim 1, wherein the micro structures form a plurality of micro holes in a surface of the connecting layer and the carbon layer penetrates into the micro holes.

3. The commutator of claim 2, wherein the micro holes have a diameter of less than 0.5 mm.

4. The commutator of claim 1, wherein the connecting layer is formed from material selected from the group: metal foam and metal fiber felt.

5. The commutator of claim 1, wherein the material of the connecting layer is copper, nickel or alloys thereof.

6. The commutator of claim 1, wherein the connecting layer is soldered to the connector.

7. The commutator of claim 1, wherein the micro structures form a plurality of bur like projections extending from a surface of the connecting layer and the bur like projections penetrate into the carbon layer.

8. The commutator of claim 7, wherein the bur like projections have a diameter of less than 0.5 mm.

9. The commutator of claim 1, wherein the connecting layer and the connector are formed as a monolithic structure.

10. The commutator of claim 1, wherein the carbon layer is sintered after the connecting layer has been attached.

11. The commutator of claim 1, wherein the connecting layer has a solder layer applied to the surface remote from the carbon layer.

12. The commutator of claim 1, wherein the commutator is a planar type commutator.

13. The commutator of claim 1, wherein the commutator is a cylindrical type commutator.

14. The commutator of claim 1, wherein the hub is molded to the segments and the connector has at least one anchor which extends into the hub to aid attachment.

15. A commutator for an electric motor, comprising:

a plurality of segments forming a brush contact surface, each segment comprising:

a connector having a terminal for connection of a lead wire, a connecting layer having a surface with a plurality of microstructures; and a carbon layer made of carbon powder and having a front surface serving as a brush contact surface and a back surface electrically and mechanically bonded to the surface of the connecting layer via a pressing process that causes the carbon power of the carbon layer to firmly engage with the plurality of microstructures on the surface of the connecting layer, the connecting layer further having another surface opposing the surface with microstructures forming micro holes or micro projections having a diameter of less than 0.5 mm, the connector being fixed to said another surface of the connecting layer; and a hub supporting the plurality of segments and electrically insulating the plurality of segments from each other.

16. The commutator of claim 15, wherein the connecting layer is formed from material selected from a group: metal foam and metal fiber felt; and the micro structures form a plurality of micro holes in a surface of the connecting layer and the carbon powder of the carbon layer penetrates into the micro holes of the connecting layer.

17. The commutator of claim 1, wherein the carbon layer has a thickness greater than that of the connecting layer.

18. A commutator for an electric motor, comprising:

a plurality of segments forming a brush contact surface, each segment comprising:

a connector having a terminal for connection of a lead wire, a carbon layer forming the brush contact surface and being made of carbon powder, and a connecting layer with a plurality of micro holes having a diameter of less than 0.5 mm, the carbon layer having a thickness greater than that of the connecting layer, the connecting layer being electrically and mechanically fixed to the carbon layer and electrically connecting the carbon layer to the connector which results in the carbon layer and the connector being respectively fixed to opposite surfaces of the connecting layer, the connecting layer being formed from material selected from a group: metal foam and metal fiber felt, the carbon powder of the carbon layer penetrating into the micro holes of the connecting layer, and a hub supporting the plurality of segments and electrically insulating the plurality of segments from each other.

* * * * *